United States Patent [19]

Cochran, Jr.

[11] 4,104,696

[45] Aug. 1, 1978

[54] GRID WIRE SUPPORT

[75] Inventor: John M. Cochran, Jr., Greenville, S.C.

[73] Assignee: Frontier Electronics, Inc., Greenville, S.C.

[21] Appl. No.: 801,077

[22] Filed: May 27, 1977

[51] Int. Cl.[2] ..... F24F 3/12

[52] U.S. Cl. ..... 361/229; 55/147; 55/148; 55/151; 361/231

[58] Field of Search ..... 361/212, 213, 216, 220, 361/225, 229, 230, 23; 55/120, 129, 138, 140, 146, 150, 147, 148, 151, 153

[56] References Cited

U.S. PATENT DOCUMENTS

| | | | |
|---|---|---|---|
| 2,343,338 | 3/1944 | Steel | 361/231 |
| 3,735,560 | 5/1973 | Wellman | 55/151 |
| 3,840,020 | 10/1974 | Smith | 361/231 |
| 3,942,072 | 3/1976 | Best et al. | 361/231 |
| 4,064,548 | 12/1977 | Best et al. | 361/229 |

*Primary Examiner*—Gerald Goldberg
*Attorney, Agent, or Firm*—Bailey, Dority & Flint

[57] ABSTRACT

A grid wire for use in a duct for imparting ions in the air flowing through the duct responsive to a voltage being placed on the grid. The grid includes a housing which has upper, lower and intermediate horizontally extending supports carried therein. Laterally spaced grid wires extend between the upper and lower support members. Screw means are provided for securing the grid wires to the intermediate non-conductive support members so as to minimize the length of the free swinging portion of the wire in case the wire breaks. By making the intermediate support member non-conductive a more uniform discharge of ions is produced by the grid.

4 Claims, 6 Drawing Figures

Fig. 1.
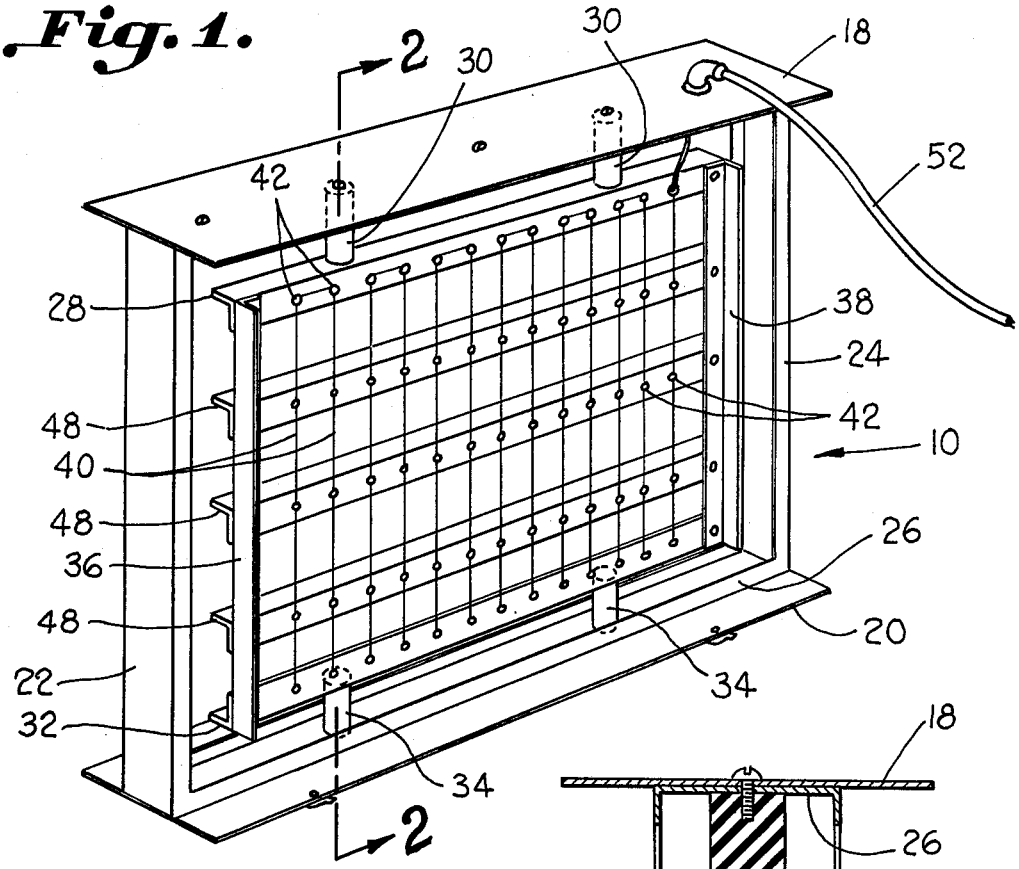
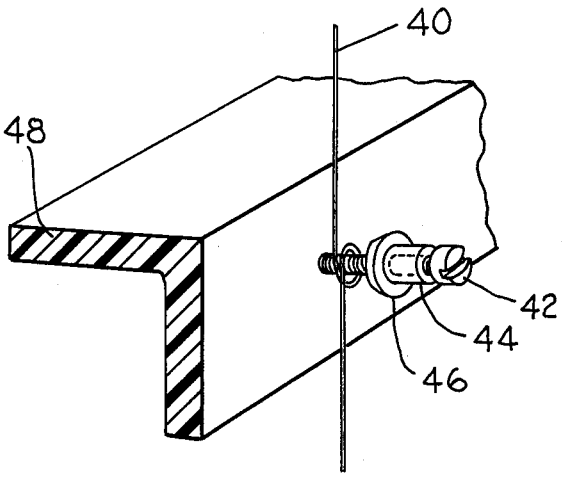
Fig. 3.
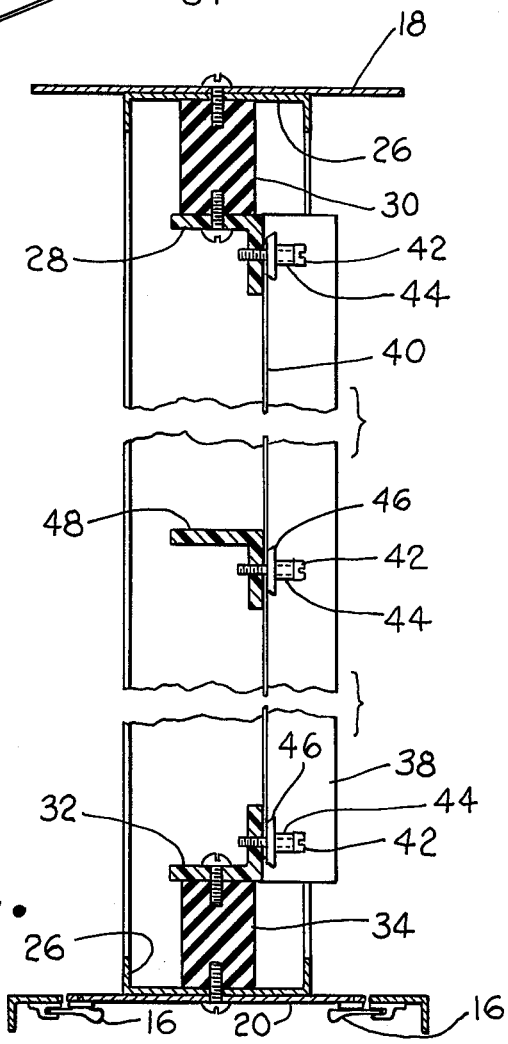
Fig. 2.

GRID WIRE SUPPORT

BACKGROUND OF THE INVENTION

The present invention relates to a grid, and more particularly to a grid system which imparts ions to air flowing through a duct which includes an intermediate support member constructed of non-conductive material so as to permit a uniform distribution of ions throughout the duct.

In most confined areas where large machines are in operation, such as textile mills, the air within the area has either a positive or negative electrical field. In the textile industry this field oftentimes has an adverse affect on the processing of fibers due to the buildup of either positive or negative ions within the fiber processing area. By adjusting the ion level within the area, either positive or negative or maintaining it neutral, the running conditions for the machinery within the area can be improved considerably. It has been found that the preferred ion level varies from plant to plant.

One attempt to correct this problem is disclosed in U.S. Pat. No. 3,942,072. In this particular patent two sets of grids, which are spaced sequentially from each other in a duct are utilized for imparting both negative and positive ions to the air flowing therethrough. A sensor is positioned within the room so as to measure the ion level therein. The sensor sends a signal to the control unit where the ion level is recorded. If the ion level deviates from a predetermined level the control unit, in turn, causes either a positive or negative voltage to be applied to the particular grid for either adding positive or negative ions to the air depending on the desired predetermined condition.

The grid shown in U.S. Pat. No. 3,942,072 includes grid wires which are strung between a pair of supporting members. The upper supporting member to which a voltage is imparted is normally conductive whereas the lower supporting member is non-conductive. These supporting members are insulated from the duct through which the air flows. One problem with the device illustrated in FIG. 2, of U.S. Pat. No. 3,942,072 is that flexing of the duct often will cause the grid wires to break. In an attempt to solve this problem, the grid was made in the form of a rigid rectangular frame with the grid wires strung between the upper portion of the frame to the bottom portion. Intermediate braces were also provided in this frame so as to prevent the grid wires from being blown into the adjacent grid and shorting out if they happened to break. By providing an intermediate support member, this limited the length of the broken free-swinging grid wire.

One problem encountered by providing intermediate support angle members of conductive material is that the conductive intermediate brace inhibited the emissions of ions from the grid wires closely adjacent thereto. This, in turn, reduced the efficiency of the grid as well as produced a non-uniform distribution of ions throughout the duct.

SUMMARY OF THE INVENTION

The grid constructed in accordance with the present invention includes intermediate support members which are carried within a housing between an upper and lower support member. Grid wires extend between the upper conductive and lower non-conductive support members and are attached to the intermediate non-conductive support members. As a result of the lower and intermediate members being constructed of non-conductive material, ions are discharged from the grid wires closely adjacent the lower and intermediate support members when a voltage is applied to the grid system.

Accordingly, it is an object of the present invention to provide a grid system with lower and intermediate non-conductive support system which minimizes the effect on generating ions by the electrically charged grid wires.

Another important object of the present invention is to provide a grid for use in a duct for imparting ions in air flowing through the duct in a substantially uniform manner throughout the duct.

These and other objects and advantages of the invention will be apparent upon reference to the following specification, attendant claims and drawings.

BRIEF DESCRIPTION OF THE DRAWINGS

FIG. 1 is a perspective view of a grid that is adapted to be inserted in a duct for generating ions that includes structure for supporting the grid wires in accordance with the present invention, FIG. 2 is a sectional view taken along lines 2—2 of FIG. 1, FIG. 3 is an enlarged fragmentary perspective view illustrating the manner in which the grid wires are attached to a supporting member.

DESCRIPTION OF A PREFERRED EMBODIMENT

Figure 4:
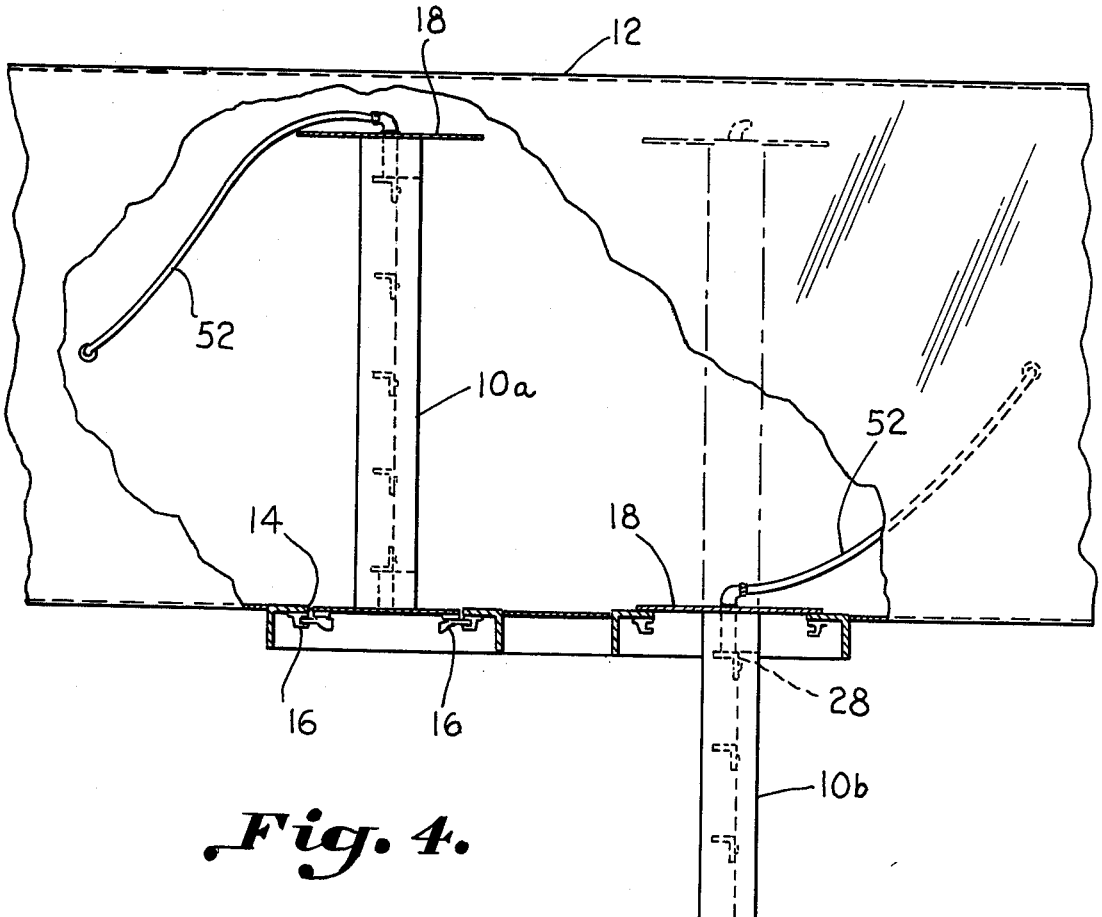
FIG. 4 is a side elevational view with parts broken away for purposes of clarity illustrating the manner in which the grid is mounted within an air flow duct.

Referring in more detail to FIGS. 1 and 4 of the drawings, there is illustrated a grid, generally designated by the reference character 10 in FIG. 1. In FIG. 4 the grid 10*a* is provided for emitting negative ions while the grid 10*b* is provided for emitting positive ions. These grids are mounted within a conventional duct 12 that is utilized for moving air throughout a mill or the like. The duct 12 is constructed of any suitable material such as sheet metal. The duct has an opening 14 provided in the bottom thereof through which the grid is permitted to drop as illustrated on the right in FIG. 4, so as to permit servicing thereof. Latches 16 are carried on the bottom of the grid which cooperate with a fastener provided on the bottom of the duct for securing the grid 10 in the duct.

The grid includes a housing which is defined by a top plate 18 and a bottom plate 20 which are joined by channel-shaped members 22 and 24. In order to add rigidity to the system bottom and top channel members 26 are secured to the top plate 18 and bottom plate 20.

The top plate 18 has a width slightly larger than than the opening provided in the bottom of the duct so that when the latches 16 are released, the grid is permitted to drop down through the bottom of the duct and rest on the top plate 18. This permits a serviceman to have both hands free while repairing or cleaning the grid wires forming part of the grid.

Positioned within the housing is a horizontally extending electrically conductive upper support member 28 which may be constructed of any suitable material such as aluminum angle. Insulators 30 are connected between the top plate 18 plus channel member 26 and the upper member 28 for supporting the upper member 28 while maintaining electrical isolation therebetween.

A bottom non-conductive horizontally extending support member 32 is supported on insulators 34 for electrically isolating the bottom member 32 from the base channel member 26 plus bottom plate 20. Vertically extending side braces 36 and 38 are connected between the bottom support member 32 and the top support member 28. These vertically extending side members 36 may be constructed of any suitable material such as aluminum angle or non-conductive material.

Tungsten grid wires 40 extend between the upper support member 28 and the bottom support member 32 and are secured thereto by means of non-conductive screws 42.

The screws 42 have a tubular plastic sleeve 44 positioned thereon between the head of the screw and a washer 46. When securing the grid wire, the grid wire 40 is normally wrapped around the inner end of the screw 42 between washer 46 and support 28, 48, or 32 after tightening the screw. When the screw 42 is tightened, the resiliency of the sleeve 44 acts as a spring causing a predetermined pressure to be applied to the grid wire 42 for securing the grid wire to the support members. Thus the wire may be removed and replaced without using a screwdriver.

Positioned between the upper and lower support members 28 and 32 are horizontally extending intermediate support members 48. These intermediate support members 48 are constructed of non-conductive material, and in one particular application are made of angled plexiglass. The intermediate members are secured between the vertically extending side braces 36 and 38 by any suitable means such as screws.

The grid wires 40 are attached to the intermediate support members by non-conductive screws 42 in the manner illustrated in FIG. 3. The vertical spacing between the intermediate members 48 is such that if a grid wire 40 breaks, the free end of the grid wire between adjacent support members is short enough so that it will not be blown into the adjacent grid located in the duct 12 so as to cause a short circuit between the grids. In other words, as illustrated in FIG. 4, the longitudinal spacing between the grids 10*a* and 10*b* is greater than the spacing between the intermediate support members 48 of a particular grid.

It has been found in the past that when conductive support members 48 are utilized such would interfere with the ion discharge from the grid wires 40. Oftentimes there would be no discharge of ions within two to three inches of the intermediate support members 48. Thus it can be seen that this adversely affected the efficiency of the grid system, as well as adversely affecting the overall discharge pattern of ions.

Figure 5:
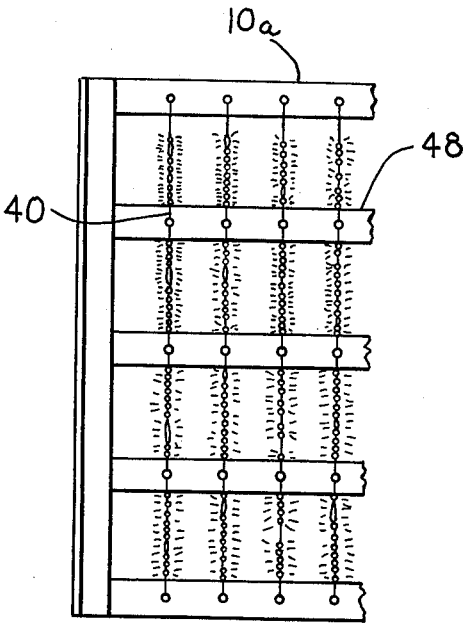
FIG. 5 is a schematic representation illustrating the manner in which the negative ions are discharged from the grid wires.
Figure 6:
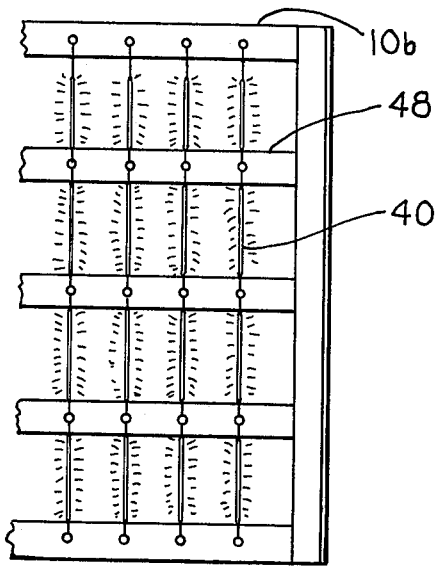
FIG. 6 is a schematic representation illustrating the manner in which the positive ions are discharged from the grid wires.

By using plexiglass intermediate members 48 it has been found that the ions are discharged from the grid wires 40 closely adjacent to the intermediate members 48 as illustrated in FIGS. 5 and 6 so that a more uniform discharge of ions takes place from the grid wires throughout the duct work, as well as increasing the efficiency of the grid system.

While it is not known exactly why the conductive intermediate support members affect the discharge of ions from the grid wires, it is thought that it is due to the cancelling of the point charge effect of the wire. In one particular embodiment the wires are 0.005 inches in diameter which creates substantially a point charge effect producing the discharge of ions.

In FIG. 5, the grid wires graphically represent the appearance of negative ions being emitted when photographed. The grid wires 40 of FIG. 6 illustrate the emission of positive ions. It is to be understood that the grid wires of FIG. 6 would form part of the grid 10*b* of FIG. 4, whereas the grid wires of FIG. 5 would form part of the grid 10*a* illustrated in FIG. 4.

As illustrated in FIG. 4, in order to service the grid wires it is only necessary to unlatch the latches 16 and drop the grid system down through the bottom of the duct 12. The grid rests on the top plate 18. A flexible electrical conductive wire 52 extends through a side wall of the duct and is attached directly to the upper support member 28. By providing a direct connection between a power source through the conductor 52 and the upper conductive member 28 such minimizes the voltage drop across the connection.

While a preferred embodiment of the invention has been described using specific terms, such description is for illustrative purposes only, and it is to be understood that changes and variations may be made without departing from the spirit or scope of the following claims.

What is claimed is:

1. A grid for use in a duct for imparting ions in the air flowing through said duct responsive to a voltage being imparted to said grid from a voltage source, said grid comprising:

a housing corresponding in shape to the interior of said duct;

a horizontally extending upper support member carried adjacent the top of said housing:

a horizontally extending non-conductive lower support member carried adjacent the bottom of said housing;

a horizontally extending non-conductive intermediate support member carried in said housing between said upper and lower support members;

laterally spaced grid wires extending between said upper and lower support members; and means for securing said grid wires to said horizontally extending non-conductive intermediate support member so as to minimize the length of free swinging wire in case a grid wire breaks;

whereby a substantially uniform discharge of ions is produced by said grid wires when a voltage is applied to said grid and grid wires.

2. The grid as set forth in claim 1 wherein said intermediate support member is an elongated plexiglass angle member.

3. The grid as set forth in claim 1 further comprising:

a flexible electrical cable extending from said voltage source through a wall of said duct to said upper support member through which electrical connection is made between said voltage source and said grid;

said flexible electrical cable being of sufficient length for permitting said grid to be removed from said duct for servicing without breaking the connection between said cable and said grid.

4. The grid as set forth in claim 1 further comprising a plurality of vertically spaced horizontally extending non-conductive intermediate support members carried between said upper and lower support members, and means for securing said grid wires to said plurality of intermediate support members.

* * * * *